United States Patent [19]

Herrmann et al.

[11] 3,976,583

[45] Aug. 24, 1976

[54] ELECTROPHOTOGRAPHIC DEVELOPER LIQUID

[75] Inventors: Heinz Herrmann; Alfred Brechlin, both of Wiesbaden-Biebrich, Germany

[73] Assignee: Hoechst Aktiengesellschaft, Germany

[22] Filed: Dec. 19, 1973

[21] Appl. No.: 425,946

[30] Foreign Application Priority Data

Dec. 21, 1972 Germany ..... 2262603

[52] U.S. Cl. ..... 252/62.1 L; 96/1 LY; 427/17

[51] Int. Cl.[2] ..... G03G 9/12

[58] Field of Search ..... 252/62.1 L; 117/37 LE; 96/1 LY; 106/285; 427/17

[56] References Cited

UNITED STATES PATENTS

| | | | |
|---|---|---|---|
| 3,001,888 | 9/1961 | Metcalfe et al. | 117/37 LE |
| 3,068,115 | 12/1962 | Gundlach | 117/37 LE |
| 3,084,043 | 4/1963 | Gundlach | 252/62.1 L |

FOREIGN PATENTS OR APPLICATIONS

| | | | |
|---|---|---|---|
| 1,181,287 | 2/1970 | United Kingdom | 252/62.1 |

*Primary Examiner*—Richard D. Lovering
*Attorney, Agent, or Firm*—James E. Bryan

[57] ABSTRACT

This invention relates to an electrophotographic developer liquid comprising a dispersion of a colored, viscous solution of polymers containing about 0.01 to 10 per cent by weight of water, calculated on the weight of polymers present, in an electrically insulating carrier liquid having a kauri-butanol value of less than about 30 and in which at least one of the polymers is sparingly soluble. The invention also relates to a process for the preparation of the novel electrophotographic developer liquid.

5 Claims, No Drawings

ELECTROPHOTOGRAPHIC DEVELOPER LIQUID

The present invention relates to an electrophotographic developer liquid composed of a dispersion of a colored viscous solution of polymers in an insulating carrier liquid with a kauri-butanol value below about 30 — measured by the ASTM method D 1133 — in which at least one of the polymers employed is sparingly soluble.

In the electrophotographic reproduction process, an electric charge image corresponding to the original is produced on a photoconductor layer and then made visible by means of a developer, the so-called toner. During recent years, two processes, above all, have proved to be especially advantageous in practice:

For the first process, paper carrying a photoconductive zinc oxide/binder layer is employed. The charge image produced in known manner on the zinc oxide paper is developed with the aid of a developer liquid, i.e. a dispersion of a pigment in an insulating liquid containing a resin. The deposited pigment particles are cemented to the surface of the zinc oxide paper by the resin contained in the dispersion so that a fixed copy is immediately obtained which is fast to wiping under normal conditions of use.

According to the other of the two processes, the electrostatic charge image is produced on a drum provided with a photoconductive coating and is then developed by means of a toner powder, i.e., a finely pulverized mixture of pigments and polymers. The toner powder, which adheres to the drum by electrostatic forces, is transferred in an electric field onto ordinary paper where it is fixed by the action of heat or a solvent. Amorphous selenium or organic substances are normally used as photoconductive substances. After cleaning the drum, the copying process may be repeated.

Dry developer powders composed normally of toner particles and carrier particles, i.e. iron filings, lacquered glass balls or tiny metal balls, have certain disadvantages as compared with developer liquids. The toner must be prepared by melting the basic materials, grinding the resulting mixture, and screening the ground mixture, which means that the process used for preparing such toners is more tedious and more expensive. Prior to use, the toners normally must be mixed with the carrier particles, some of which require a special pre-treatment so that a triboelectric charge opposite to that of the charge image is produced. Further, dust-forming developer powders can be handled less easily in reproduction machines than liquid developers. The powder image produced on the copy paper must be additionally fixed, and this normally requires much energy. For these reasons, attempts already have been made to use developer liquids for the second type of process also, but images produced with liquid developers do not lend themselves easily to the transfer onto copy paper.

Therefore, several methods already have been suggested for improving the transfer of an image developed with a developer liquid from the photoconductor drum onto paper. In the processes described in German Offenlegungsschriften Nos. 2,110,409, 2,144,066, and 2,147,646, special, polymer-containing papers having a low oil adsorption coefficient are used, and according to German Offenlegungsschrift No. 2,127,838, instead of removing excess developer liquid from the image, the image is transferred onto paper which has been moistened with a solvent of low boiling point to prevent it from absorbing the developer liquid.

According to still another process, modified developer liquids are used which are composed of dispersions of colored polymers in a carrier liquid in which the polymers are substantially insoluble. The colored polymer particles contain a small proportion of a true solvent. In this manner, a slightly tacky image is produced on the photoconductor drum which may be transferred onto the copy paper without the use of an electric field, solely by its tackiness. After evaporation of the small quantity of solvent, a satisfactorily fixed, non-tacky copy is obtained.

The above described processes for transferring an image developed by a liquid developer from the photoconductor layer onto paper have the following disadvantages, however:

The use of specially pre-treated papers is uneconomical and restricts the application range of the process. Moistening the paper with readily volatile solvents makes it impossible to achieve a high copying speed and, moreover, causes an unnecessary air pollution. The dispersion of the colored solvent-containing polymer particles used according to the prior art possesses a stability which is not altogether satisfactory for practical purposes. The particles are only incompletely transferred at higher copying speeds, because they adhere too firmly to the photoconductor layer. This is also disadvantageous when the drum of the copying machine is to be cleaned to prepare it for the next copying operation.

Thus, it is the object of the present invention to provide a liquid developer which is more suitable for the last-mentioned process, which allows a better transfer of the developed image from the photoconductor drum onto the copy paper, and which, if possible, also possesses an improved stability.

This object is achieved by using an electrophotographic developer liquid of the above described type, in which the solution of the polymers contains about 0.01 to about 10 percent by weight of water, calculated on the weight of the polymers present. In a preferred embodiment, the solution contains about 0.1 to about 2 percent by weight of water, bsased on the polymers used.

Surprisingly, the liquid developer according to the present invention allows an improved transfer of the developed charge image from the photoconductor layer onto the copy paper. Since only a weak ghost image remains on the photoconductor layer, it can be more easily cleaned for the following reproduction operation. The images produced are free from scum and rich in contrast. Moreover, the developer liquid according to the invention has a better shelf-life than have comparable developers.

The developer liquids according to the invention are prepared by carefully dispersing pigments and dyestuffs in highly concentrated solutions of polymers and slowly precipitating the colored solutions by the addition of a substantially non-dissolving carrier liquid composed of a lower hydrocarbon with a kauri-butanol value of less than about 30.

Preferably, a three-rol mill is used for dispersion, but other efficient mixers, e.g. a dissolver, also may be used.

Normally, the polymers are colored with carbon black. In order to facilitate the dispersing process, commercially available predispersed carbon black, e.g. resin-treated carbon black, also may be employed. Fundamentally, however, any other known pigment may be used.

Organic dyestuffs may be added to the pigment in order to improve its color shade and to influence the triboelectric charge of the toner particles. Dyestuffs, such as "Reflexblau B" (C.I. 42765), "Fettschwarz HB" (C.I. 26,150), or "Nigrosin spritloslich" (C.I. 50420) may be used for the preparation of developer liquids assuming a positive charge, which are required for developing negatively charged images. Besides these, a variety of other dyestuffs may be used, especially those containing ammonium groups. As in the case of the pigments used, it may be of advantage to add the dyestuffs in a predispersed form, using, e.g., the "Reflexblau" paste A6H-G sold by Farbwerke Hoechst A.G., Frankfurt/M., Germany The polymers used for the preparation of the organosol-type developer liquids in the form of colored, viscous solutions, must have the following characteristics:

They must be substantially insoluble in the carrier liquid, so that they can be directly precipitated from the solution by adding the insulating carrier liquid. On the other hand, the polymers must dissolve easily in another solvent which mixes readily with the carrier liquid, so that a viscous solution can be prepared. The solution must have a high viscosity in order to permit a good dispersion of the pigment. Further, it is necessary for the solution to have a high solids content because otherwise the finished toner has an undesirably high solvent content. Finally, the polymers must have the desired triboelectric charge after precipitation from the solution.

Suitable polymers are the copolymers of vinyl toluene or styrene with acrylic acid esters. The vinyl toluene/acrylic resin known under the designation "Pliolite VTAC" (a product of Goodyear Tire and Rubber Co., Akron, Ohio, USA) has been found to be particularly advantageous. Suitable solvents for the polymers are aromatic hydrocarbons, halogenated hydrocarbons, and esters. The aromatic hydrocarbons have been found to be particularly suitable, especially those having boiling ranges between about 160° and about 180°C, e.g. "Solvesso 100" (a product of Esso AG., Hamburg, Germany).

As the insulating carrier liquid with a kauri-butanol value of less than about 30, those are used which have a high electrical resistance and a low dielectric constant. Such liquids are, above all, aliphatic hydrocarbons with a boiling range between about 120°C and about 200°C. Preferably, a hydrocarbon is used which has a boiling range between 159° and 179°C, e.g. "Isopar G" (a product of Esso AG., Hamburg, Germany). Since the particles formed during the precipitation of polymer solutions tend to agglomerate within a short time, as a rule, at least a second polymer acting as a protective colloid is added to the viscous solution in order to prevent such agglomeration. This protective colloid must be at least partially soluble in the solvent used for dissolving the organosol-forming polymer, as also in the carrier liquid used for precipitation.

Polymers meeting these requirements are, e.g. butadiene/styrene copolymers, such as the products known by the name "Solprene" (marketed by Phillips Petroleum Co., New York, N.Y., USA). A copolymer consisting of 75 percent butadiene and 25 percent of styrene has proved to be particularly suitable ("Solprene 1205").

During precipitation of the colored viscous solution of the organosol-forming polymer and the polymeric protective colloid, the mixture must be dispersed in order to produce an organosol composed of very fine particles. Therefore, dilution with the non-dissolving carrier liquid is conducted while vigorously stirring. Mixers of various types may be used for this purpose, e.g. the so-called dissolvers. The simplest method comprises adding the carrier liquid to the colored viscous solution of the polymers with continuous, vigorous agitation, the carrier liquid being only slowly added. The organosol particles thus formed are ball-shaped. Alternatively, the solution may be precipitated in the reverse manner, i.e. by adding the solution slowly to the carrier liquid with vigorous agitation.

The water content present according to the invention is adjusted at the beginning of the manufacturing process, by adding either a corresponding quantity of distilled water, or of water-miscible solvents which contain water, e.g. from their preparation.

Water-miscible solvents which may be used for this purpose are all known solvents containing traces of water, such as mono- or multivalent alcohols having from 1 to 4 carbon atoms, e.g. methanol, glycol or their simple derivatives, such as methyl glycol or dioxane, also lower ketones with 1 to 5 carbon atoms, e.g. acetone or methyl ethyl ketone, and also aceto nitrile.

Whereas distilled water may be added at any time before precipitation of the polymer solution by the carrier liquid, the watermiscible solvent must be added before dispersion, i.e. before incorporating the pigment and/or the dyestuff. In this manner, the solvent may evaporate during the dispersing process.

Preferably, the water contained in the colored, viscous solution of the polymers is added by incorporating water-miscible solvents.

The water content of the solution of the polymers is adjusted to a value between about 0.01 and about 10 percent by weight, based on the weight of the polymers present. Preferably, this value should be between 0.1 and 2 percent by weight.

In contradistinction to the conventional non-transferable toners for liquid development of zinc oxide papers, in which pigments and polymers are present in approximately comparable quantities, the water-containing colored polymer solutions according to the invention contain only about 1 part by weight of pigment and/or dyestuff per 5 to 50, preferably 10 to 20 parts by weight of polymers. The polymer solutions have a concentration between about 30 and 70 percent, preferably between 50 and 60 percent.

Depending upon the intended use, precipitation may be performed in stages, so that toner concentrations are produced which can be adjusted later to the desired developer concentration simply by adding additional carrier liquid.

The mechanism of the surprising effect achieved by the water content has not yet been explained. It was found, however, that, contrary to expectation, the electroconductivity of the colored viscous solution of the polymers is reduced by the addition of water. Further, it is assumed that the adhesion of the particles to the hydrophobic photoconductor layer is at least reduced by the water content, while their adhesion to the hydrophilic copy paper is increased.

The invention will now be described in more detail by reference to the following examples. The quantities stated are grams in the case of solids and milliliters in the case of liquids.

EXAMPLES 1 to 3

For the preparation of colored viscous solutions of polymers, the following basic materials are mixed into a dough and then dispersed on a three-roll mill for laboratory use (Type SDH, a product of Messrs. Bühler, Utzwil, Switzerland) until optimum dispersion of the pigments and dyestuffs has been achieved.

| Basic Material | Ex. 1 | Ex. 2 | Ex. 3 |
|---|---|---|---|
| Vinyl toluene/acrylic ester copolymer ("Pliolite VTAC") | 36.5 | 35 | 30 |
| Butadiene/styrene copolymer ("Solprene 1205") | 24.3 | 25 | 30 |
| Pre-dispersed carbon black ("Mikrolith Schwarz 21816 T", a product of Ciba-Geigy, Basel, Switzerland) | 6.6 | 9 | 6.6 |
| Pre-dispersed dyestuff ("Reflexblau A6H-G") | 0.85 | — | 0.85 |
| "Fettschwarz HB" (C.I. 26150) | — | 0.3 | — |
| Aromatic hydrocarbon, boiling range 160–180°C ("Solvesso 100") | 70 | 50 | 40 |
| Distilled water | 1 | — | — |
| Ethanol | — | 25 | — |
| Acetone | — | — | 30 |

After dispersion on the three-roll mill, each mixture is slowly diluted by adding 100 parts by weight of a lower aliphatic, branched hydrocarbon with a boiling range between 159° and 179°C and a kauri-butanol value of 27 (Isopar G, a product of Esso AG., Hamburg, Germany), while stirring with a dissolver (laboratory type) at 3,000 revolutions per minute.

Further dilution, to yield the finished toner concentrate, takes place after three days' ripening, 1 part of the ripened mixture being mixed with 2 parts by weight of Isopar G with stirring.

For the preparation of the ready-for-use developer, the toner concentrates produced as described above are again mixed with Isopar G at a ratio of 1 to 3.

When the three developer liquids thus obtained were used for developing negative charge images produced by electric charging and image-wise exposure of an organic photoconductor layer composed of activated polyvinyl carbazole, images were obtained which were free from scum and rich in contrast. After excess developer had been squeezed off, the images could be transferred almost completely onto ordinary paper by a simple contact process.

It will be obvious to those skilled in the art that many modifications may be made within the scope of the present invention without departing from the spirit thereof, and the invention includes all such modifications.

What is claimed is:

1. An electrophotographic liquid dispersion developer for transferring a developed charge image from a photoconductor onto a paper comprising an electrically insulating carrier liquid, having a kauri-butanol value of less than about 30, in which is dispersed a solution containing a. a solvent organic liquid, which is miscible with the carrier liquid, b. a copolymer (A) of vinyl toluene or styrene with an acrylic acid ester which is soluble in the solvent and substantially insoluble in the carrier liquid, c. a copolymer (B) of butadiene with styrene, which is soluble in the solvent and in the carrier liquid, said copolymers (A) and (B) being present in an amount between about 30 and 70 percent by weight, calculated on the weight of solvent, d. a coloring material substantially insoluble in the carrier liquid, and e. water in an amount of about 0.01 to 10 percent by weight, calculated on the weight of copolymers A and B present.

2. A liquid dispersion developer according to claim 1 in which the amount of water is about 0.1 to about 2 percent by weight, calculated on the weight of copolymers A and B present.

3. A liquid dispersion developer according to claim 1 in which copolymer (B) is a copolymer consisting of 75 percent of butadiene and 25 percent of styrene.

4. A process for the preparation of an electrophotographic liquid dispersion developer for transferring a developed charge image from a photoconductor layer onto paper comprising dispersing in an electrically insulating carrier liquid having a kauri-butanol value of less than about 30, a solution containing a. a solvent organic liquid, which is miscible with the carrier liquid, b. a copolymer (A) of vinyl toluene or styrene with an acrylic acid ester, which is soluble in the solvent and substantially insoluble in the carrier liquid, c. a copolymer (B) of butadiene with styrene, which is soluble in the solvent and in the carrier liquid, said copolymers (A) and (B) being present in an amount between about 30 and 70 percent by weight, calculated on the weight of solvent, d. a coloring material substantially insoluble in the carrier liquid, and e. water in an amount of about 0.01 to 10 percent by weight, calculated on the weight of copolymers A and B present.

5. A process according to claim 4 in which the amount of water is about 0.1 to about 2 percent by weight, calculated on the weight of copolymers A and B present.

* * * * *